US006362565B1

(12) United States Patent
Katase et al.

(10) Patent No.: US 6,362,565 B1
(45) Date of Patent: Mar. 26, 2002

(54) ELECTRODELESS DISCHARGE LAMP AND APPARATUS TO PREVENT DEVITRIFICATION

(75) Inventors: Koichi Katase, Osaka; Tsuyoshi Ichibakase, Takatsuki; Katsushi Seki, Shiga-ken, all of (JP)

(73) Assignee: Matsushita Electric Industrial Co., Ltd., Oaska (JP)

( * ) Notice: Subject to any disclaimer, the term of this patent is extended or adjusted under 35 U.S.C. 154(b) by 0 days.

(21) Appl. No.: 09/416,996

(22) Filed: Oct. 13, 1999

(30) Foreign Application Priority Data

Oct. 21, 1998 (JP) ..... 10-299391

(51) Int. Cl.[7] ..... H01J 17/20
(52) U.S. Cl. ..... 313/485; 313/570; 313/571
(58) Field of Search ..... 313/485, 570, 313/517, 636, 637, 638

(56) References Cited

U.S. PATENT DOCUMENTS 5,864,210 A 1/1999 Hochi et al.
5,866,981 A * 2/1999 Saimi et al. ..... 313/570
5,990,624 A * 11/1999 Mayo ..... 315/39

FOREIGN PATENT DOCUMENTS

JP 6132018 5/1994
JP 9120800 5/1997
WO 9208240 5/1992

* cited by examiner

*Primary Examiner*—Nimeshkumar D. Patel
*Assistant Examiner*—Ken A Berck
(74) *Attorney, Agent, or Firm*—Price and Gess

(57) ABSTRACT

An electrodeless discharge lamp and an electrodeless discharge lamp apparatus which prevent the devitrification are provided, where the devitrification occurs due to the use of, as a luminescent substance, a metal halide, particularly a compound made up of a group IIIB metal and a halogen. The inventors recognize the cause of the devitrification as follows: atoms of the metal are dissociated from the luminescent substance and precipitate on the surface of the arc tube wall to melt it as the luminescent substance is excited and emits light. Based on this recognition, a substance is added to the interior of the arc tube to prevent the melting of the arc tube wall and extend the life of the lamp. More specifically, the added substance is another metal halide which contains a halogen, but the valence of the metal of the added metal halide is larger than that of the luminescent-substance metal halide. In addition to this, it is possible to control the ratio of the halogen in the arc tube by controlling the amount of the added metal halide. With this construction, occurrence of the devitrification is prevented while maintaining the discharge stability. The devitrification can also be prevented by adding a simple substance of the metal constituting the luminescent-substance metal halide.

21 Claims, 3 Drawing Sheets

ELECTRODELESS DISCHARGE LAMP AND APPARATUS TO PREVENT DEVITRIFICATION

This application is based on an application No. 10-299391 filed in Japan, the content of which is hereby incorporated by reference.

BACKGROUND OF THE INVENTION (1) Field of the Invention

This invention relates to an electrodeless discharge lamp which prevents occurrence of devitrification and to an electrodeless discharge lamp apparatus which uses the electrodeless discharge lamp.

(2) Description of the Prior Art

One example of conventional electrodeless discharge lamps is disclosed in Japanese Laid-Open Patent Application No. 9-120800 in which indium halide is used as the luminescent substance. Hereinafter, electrodeless discharge lamps in which indium halide is used as the luminescent substance are referred to as indium lamps. The indium lamps have excellent color rendering properties and highly efficient optical properties since continuous spectrum of light is radiated by molecules of indium halide. Especially, it is known that indium bromide (InBr) used as the indium halide provides high luminous efficiency ("Novel High Color Rendering Electrodeless HID Lamp Containing InX," A. Hochi, M. Takeda, S. Horii, T. Matsuoka, IDW '96 proceedings, PP 435–438).

Typically, metal halide lamps having electrodes (hereinafter referred to as metal halide lamps) are each composed of a plurality of different luminescent substances to improve the luminous efficiency and the color rendering properties. As a result, as such a metal halide lamp continues to emit light and the luminescent substances are consumed, the ratio between the luminescent substances existing in the arc tube changes and the luminescent color also changes. On the contrary, the indium lamp, an electrodeless discharge lamp, which is filled with only one luminescent substance, can achieve the same or higher luminous efficiency and color rendering properties as metal halide lamps, and are hard to cause change in the luminescent color thereof.

However, conventional indium lamps have a problem that that compared to electrodeless discharge lamps in which sulfur is used as the luminescent substance (hereinafter referred to as sulfur lamps) the devitrification occurs quickly to quartz glass, the material of the arc tube, and decreases the light emission and reduces the lamp life. The sulfur lamp is disclosed in, for example, Japanese Laid-Open Patent Application No. 6-132018. For example, a continuous lighting test conducted for conventional indium lamps showed that after the test pieces are lighted for 10,000 hours, the devitrification develops in about one thirds of the area inside the arc tube in extreme ones among the test pieces.

SUMMARY OF THE INVENTION

It is therefore an object of the present invention to provide an electrodeless discharge lamp which prevents the occurrence of the devitrification and has a long life and an electrodeless discharge lamp apparatus which uses electrodeless discharge lamp. The following are details about how the inventors reached the present invention.

The devitrification of conventional indium lamps is unique compared to that of conventional metal halide lamps: the devitrification of conventional indium lamps turns the color of the arc tube to yellow, while the devitrification of conventional metal halide lamps turns the color to white. Also, the region where the devitrification occurs in conventional indium lamps belongs to neither the maximum temperature region nor minimum temperature region of the arc tube. Furthermore, no substance that is highly reactive with quartz glass, the material of the arc tube, can be contained in the arc tube. From these points, it is presumed that the devitrification of conventional indium lamps occurs through different processes from that of conventional metal halide lamps.

The inventors of the present invention analyzed conventional indium lamps and reached unique findings concerning the devitrification of the conventional indium lamps by reviewing the results of the analysis, and completed the present invention based on the findings. Now, the analysis results will be described together with the processes through which the inventors assume the devitrification occurs to indium lamps.

First, conventional indium lamps were lighted so as not to develop the devitrification, then precipitation of indium (In) was observed inside the wall of the arc tube during and after the lighting. The region on the arc tube where the precipitated indium appeared was where the wall temperature was relatively high, not where the wall temperature was the lowest. Grains of indium with the diameter of up to about 20 $\mu$m were observed to be precipitated on the surface of the wall. Also, crater-like indentations, which are assumed to be formed as the quartz glass melts, were observed in the region where the precipitation appeared.

Next, concerning the conventional indium lamps to which the devitrification had occurred, the region of the arc tube where the devitrification occurred was observed under magnification. It was found through the observation that a lot of crater-like indentations whose size is equivalent to the indium grains attached to the same region were formed in the region, and that quartz glass had partially been crystallized in the region. The crystallized portion of the quartz glass was analyzed in the direction of depth to find that indium and bromine (Br) were equally distributed in the crystallized portion. This is considered to be the reason why the devitrification part is yellow.

It summarized from the above that the crater-like indentations are formed by the heat of the precipitated indium, and that crystallization of quartz glass is also promoted by the heat.

It is concluded from the above analysis and consideration that the devitrification occurs to conventional indium lamps as follows.

In conventional indium lamps, argon (Ar), a gas for starting-up, contained in the lamps starts discharging to generate high-temperature arcs, the temperature of the wall of the arc tube easily rises, indium bromide being a luminescent substance quickly evaporates, and atoms of indium and bromine dissociated from the indium bromide or molecules of indium bromide in the high-temperature arcs are excited and perform luminous discharge. The high-temperature arcs exist even near the wall of the arc tube. That means, there are atoms or ions having high energy near the wall of the arc tube. As a result, there is a high possibility that the dissociated atoms of indium and bromine contact the arc tube wall before they recombine. When this happens, what is called halogen cycle in which the metal halide dissociates at high temperatures and recombine at low temperatures in cycles hardly happens, and this tends to create a state in which indium and bromine are liberated from each other. The inventors actually confirmed through a test lighting of less than one hour that the contents of the arc tube after the lighting partially contained indium and bromine liberated from each other.

Indium as a simple substance has a high boiling point of 2080° C. As a result, when atoms of indium reach the arc tube wall, they tend to attach to the wall even if the wall has a relatively high temperature. The indium attached to the arc tube wall during the lighting of the indium lamp is heated to a high temperature by the energy applied to the lamp for the lighting. When indium as a simple substance is heated, it passes a high temperature which can easily melt quartz glass before indium reaches its high boiling point. With such a high temperature, quartz glass softens or melts and tends to generate a crystalline nucleus. The generation of the crystalline nucleus facilitates development of the crystallization of quartz glass around the crystalline nucleus. The crystallization of quartz glass develops to the devitrification.

On the contrary, it is considered that such devitrification does not occur to sulfur lamps. This is because the luminescent substance, sulfur, has a low boiling point and a high vapor pressure.

Up to this point, the processes through which the inventors assume the devitrification occurs to indium lamps have been described. The inventors have found from these facts that the occurrence of the devitrification to conventional indium lamps can be restricted by preventing the attachment of atoms of indium to the arc tube wall. This led the inventors to the achievement of the electrodeless discharge lamp of the present invention which prevents occurrence of the devitrification. It is needless to say that the gist of the present invention can also be applied to lamps in which a material other than indium halide is used as the luminescent substance.

The above object is achieved by an electrodeless discharge lamp including: an arc tube in which a luminescent substance and a melting-interruption substance are enclosed, where the luminescent substance is a metal halide, and the melting-interruption substance interrupts elements of a metal constituting the metal halide in melting a wall of the arc tube, the elements being dissociated from the metal halide.

With the above construction, the wall of the arc tube is prevented from being melted by a metal dissociated from a metal halide used as a luminescent substance. This prevents the occurrence of the devitrification, and enables an electrodeless discharge lamp apparatus using this electrodeless discharge lamp to have a long life.

In the above electrodeless discharge lamp, the melting-interruption substance may be a metal halide, and a ratio of: a summation of the number of moles in a halogen included in the melting-interruption substance and the number of moles in a halogen included in the luminescent substance; to a summation of the number of moles in a metal included in the melting-interruption substance and the number of moles in the metal included in the luminescent substance is in a range of more than 1.02 and less than 1.07.

In the above construction, it is preferable that the ratio is in a range of 1.03 and 1.05.

In the above electrodeless discharge lamp, the melting-interruption substance may include: the metal included in the luminescent substance; and the halogen included in the luminescent substance, and composition of the melting-interruption substance is different from composition of the luminescent substance.

With the above construction, a possibility of the change in the lamp characteristics such as the luminescent color is reduced. Also, compared to a case in which a halogen as a simple substance is added, the above construction facilitates the control of the ratio between the metal and the halogen in terms of the number of moles in total.

In the above electrodeless discharge lamp, the luminescent substance may be a metal halide including a halogen and a metal which is an element belonging to the Periodic Table group IIIB, and the melting-interruption substance is a simple substance of the metal included in the luminescent substance.

The above object is also achieved by an electrodeless discharge lamp apparatus including: an electrodeless discharge lamp including an arc tube in which a luminescent substance and a melting-interruption substance are enclosed, where the luminescent substance is a univalent metal halide which includes a halogen and a metal being an element belonging to the group IIIB, and the melting-interruption substance interrupts elements of the metal constituting the metal halide in melting a wall of the arc tube, the elements being dissociated from the metal halide; and an excitation energy supplying means for supplying to the electrodeless discharge lamp an energy for exciting the luminescent substance to emit light.

BRIEF DESCRIPTION OF THE DRAWINGS

These and other objects, advantages and features of a invention will become apparent from the following description thereof taken in conjunction with the accompanying drawings which illustrate a specific embodiment of the invention. In the drawings.

DESCRIPTION OF THE PREFERRED EMBODIMENTS

Figure 1:
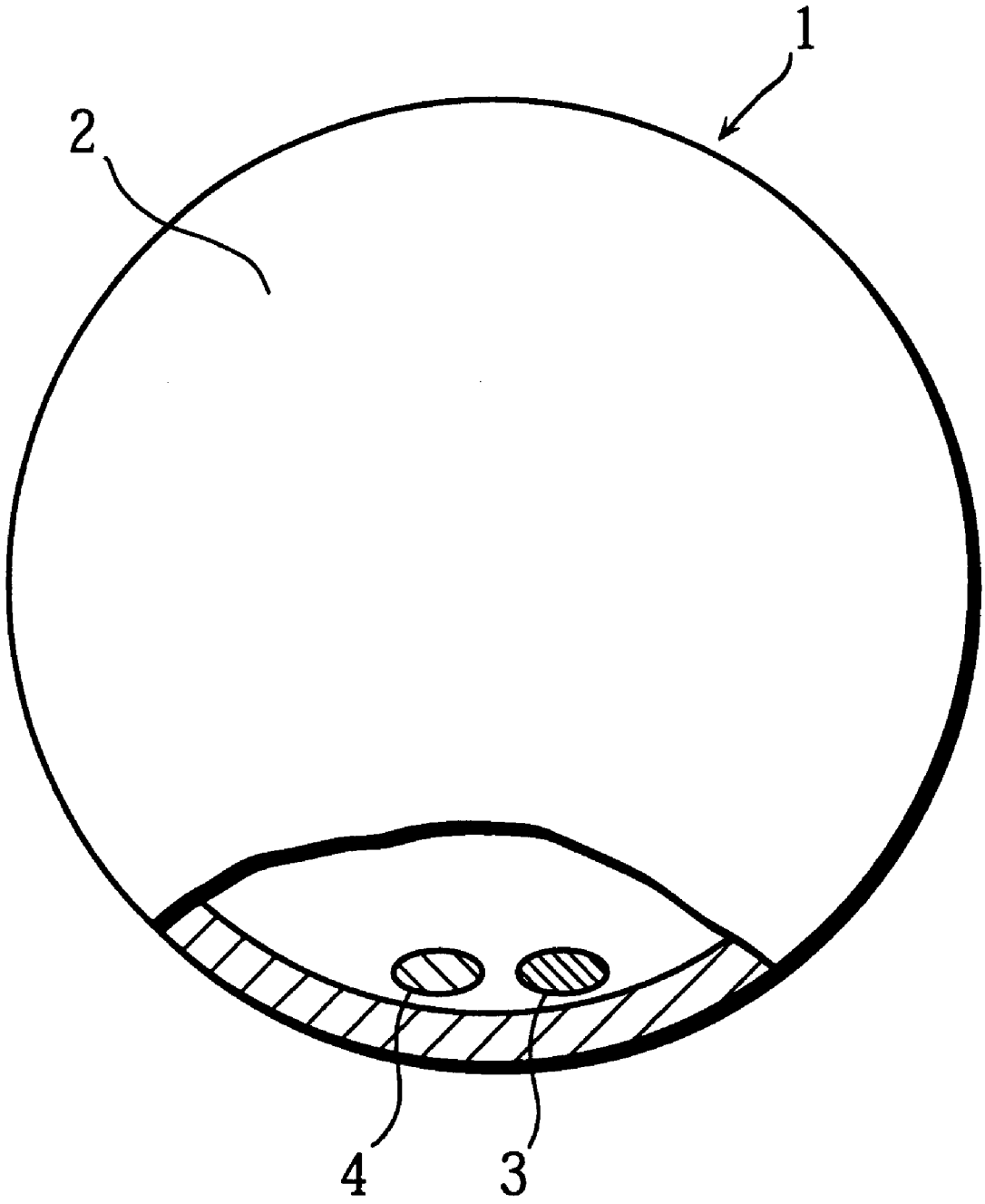
FIG. 1 is a partially exposed front view of the electrodeless discharge lamp of Embodiment 1 of the present invention.

The following are description of the present invention through specific embodiments thereof by way of referring to the drawings.

<Embodiment 1>

FIG. 1 is a partially exposed front view of the electrodeless discharge lamp of Embodiment 1 of the present invention.

As shown in FIG. 1, an electrodeless discharge lamp 1 is composed of an arc tube 2 which contains a luminescent substance and a gas for starting-up being a rare gas such as argon (Ar), where the luminescent substance is a mixture of a plurality of metal halides which are composed of the same elements but have different compositions, such as indium bromide (InBr) 3 as the first metal halide and indium tribromide ($InBr_3$) 4 as the second metal halide.

The amounts of the indium bromide 3 and the indium tribromide 4 are each set so that the number of moles of bromine is a little larger than that of indium. This setting facilitates collision between the dissociated atoms of indium and those of bromine, allows the halogen cycle to happen smoothly, and restricts the precipitation of liberated indium which accelerates the devitrification.

Figure 2:
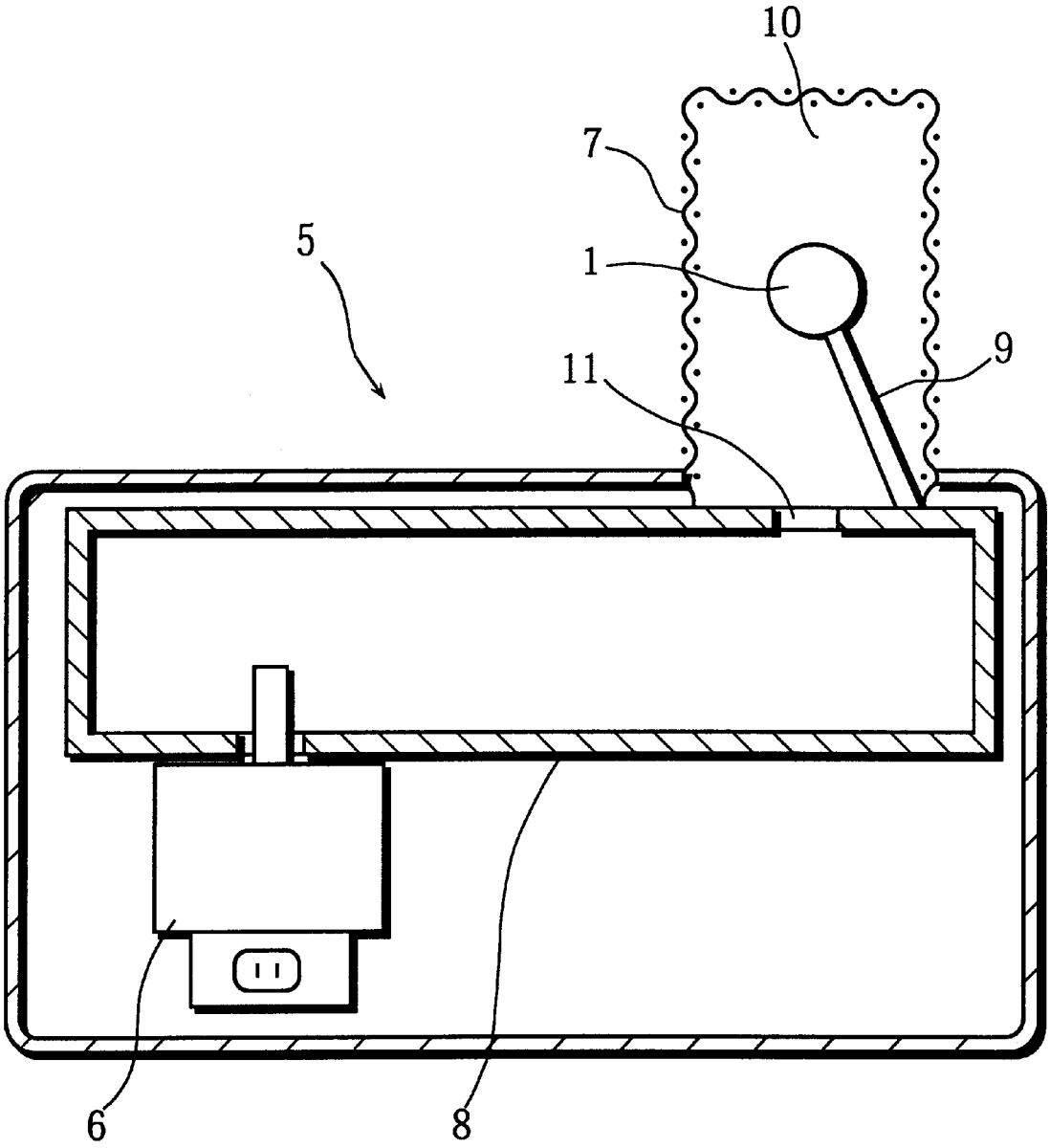
FIG. 2 shows the construction of the electrodeless discharge lamp apparatus of the present invention.

FIG. 2 shows the construction of the electrodeless discharge lamp apparatus using the electrodeless discharge lamp.

As shown in FIG. 2, an electrodeless discharge lamp apparatus 5 uses microwaves of 2.45 GHz as the energy for exciting the luminescent substance. The electrodeless discharge lamp apparatus 5 includes a magnetron 6 for generating microwaves, a container 7 with a hollow inside, a waveguide 8 for conveying the microwaves generated by the magnetron 6 into the container 7, a support rod 9 for supporting the electrodeless discharge lamp 1 which is disposed in the container 7.

To obtain stable, even luminous discharges, the support rod 9 may be connected to a motor or the like so that the electrodeless discharge lamp 1 can be lighted while rotating about the support rod 9 as the axis.

The container 7 is formed in the shape of a cylinder and made of a material which substantially does not allow the microwaves to pass through itself, allows the light to pass through, and has conductivity, such as a conductive mesh material. The container 7 is connected to the waveguide 8 so that they contact each other electrically in good conditions. A space surrounded by the container 7 and the wall of the waveguide 8 is hereinafter referred to as a microwave hollow 10. The microwave hollow 10 is connected to a transmission space in the waveguide 8 through a transmission hole 11 opened in the wall of the waveguide 8.

The magnetron 6 is provided with an antenna which protrudes through the wall of the waveguide 8 into the waveguide 8. The microwaves generated by the magnetron 6 are transmitted into the waveguide 8 through the antenna, then into the microwave hollow 10 through the transmission hole 11. The microwaves supplied to the microwave hollow 10 excite the indium bromide 3 and the indium tribromide 4 being the luminescent substances enclosed in the electrodeless discharge lamp 1 to emit light. The following are the light emission process. First, the energy of the microwaves allow argon to start discharging. The temperature in the electrodeless discharge lamp 1 rises as the vapor pressure of argon increases. This allows the indium bromide 3 and the indium tribromide 4 to evaporate and start discharging. The vapor pressure of the indium bromide 3 and the indium tribromide 4 rises. The energy of the microwaves excites the molecules of the indium bromide 3 and the indium tribromide 4 and allows them to emit light, resulting in the radiation of white light having a broad, continuous spectrum extending over the entire visible range. The light emitted from the electrodeless discharge lamp 1 passes through the container 7 and goes out of the microwave hollow 10.

Now, results of an observation performed on the electrodeless discharge lamp of the present embodiment in terms of its characteristics will be described. In this observation, for each of test pieces of the electrodeless discharge lamp with the construction shown in FIG. 1, the arc tube 2 made of anhydrous quartz glass (GE214A, less than 1 ppm of water content) with 30 mm of inside diameter was heated as a preparatory process for removing water and impurities, a mixture of the indium bromide 3 and the indium tribromide 4, with their amounts and mixture ratios being shown in Table 1, were then put into the arc tube 2, and 1.3 kPa of argon gas was enclosed in the arc tube 2. The electrodeless discharge lamps as test pieces were then lighted by the microwaves with 800 W of output power generated by the magnetron 6 (made by MATSUSHITA ELECTRONIC INSTRUMENT CO., LTD., 2M244, 1 kW of rated output) while observed in terms of lamp characteristics, precipitation of indium, discharge stability, etc. in initial state. The results show that all the test pieces are almost the same in terms of the lamp characteristics such as luminosity and emission spectrum. A visual observation was performed on the test pieces in terms of the amount of indium precipitated on the wall of the arc tube 2 during the lighting of the lamps and the discharge stability. Table 1 shows the results.

TABLE 1

| TEST PIECE | AMOUNT (mg) | | MIXTURE RATIO | PRECIPITATION OF | DISCHARGE |
|---|---|---|---|---|---|
| No. | InBr | $InBr_3$ | Br/In | In | STABILITY |
| 1 | 30.0 | 0 | 1.00 | LARGE AMOUNT | STABLE |
| 2 | 29.5 | 0.5 | 1.02 | SMALL AMOUNT | STABLE |
| 3 | 29.5 | 0.9 | 1.03 | NO | STABLE |
| 4 | 29.5 | 1.5 | 1.05 | NO | STABLE |
| 5 | 29.0 | 2.0 | 1.07 | NO | UNSTABLE |

The indium bromide (InBr) 3 and the indium tribromide ($InBr_3$) 4 used in the observation are both made by APL Engineered Materials, Inc. (at a purity of 99.999%, in the shape of pellet).

Here, the stable discharge indicates that no luminance flicker was observed for the lamp; the unstable discharge indicates that flicker was observed for the lamp. As shown in Table 1, as the ratio of bromine to indium increases, the precipitated indium reduces. When the ratio of bromine to indium in terms of the number of moles is 1.03 or more, no precipitation of indium is observed. When the ratio is 1.07, it is observed that the discharge is unstable since the arc tends to contract as the lamp is lighted. This is considered to be because halogen traps electrons. From these results, the following facts are derived: to stop precipitation of indium, the mixture ratio of bromine to indium in the number of moles should be more than 1.02, preferably 1.03 or more; and to obtain stable discharge, the mixture ratio of bromine to indium should be less than 1.07, preferably 1.05 or less.

Now, results of a test performed on the above test piece 1 (a conventional lamp with no addition of $InBr_3$) and the above test piece 3 will be described. In this test, the lamps were lighted for a long time, then observed for comparison. The test piece lamps were lighted for about 1,500 hours, then a visual observation was performed on them in terms of the occurrence of devitrification, and the luminosity of the lamps was measured by an illumination meter (MINOLTA, T-1M type).

The results of the test shows that the test piece 3 almost maintained the initial luminosity even 1,500 hours after the start and that no occurrence of devitrification was confirmed for the test piece 3. In contrast, occurrence of devitrification was visually observed in the test piece 1,500 hours after the start, and that the luminosity of the test piece 1 decreased to 90% of the initial luminosity about 1,500 hours after the start.

It should be noted here that as apparent from the results shown in Table 1, the amount of bromine to be enclosed in the arc tube should be larger than that of indium by only a trace. That is, a trace of bromine needs to be added to the interior of the arc tube which already contains indium bromide as the luminescent substance. If bromine were used as halogen, it would be difficult to control the amount of bromine to be enclosed in the arc tube. However, in the electrodeless discharge lamp of the present embodiment, a plurality of different compounds composed of the same elements are used in combination and there is no need for a trace of bromine to be added separately to indium bromide. With such a construction, it is possible to control the ratio between the elements by controlling the amount of each of the plurality of compounds. This facilitates proper control of the amounts of indium and bromine to be enclosed in the arc tube. Also, the lamp characteristics of the lamp do not sensitively change in accordance with minute changes in the amount of enclosed compounds since the compounds are composed of the same elements.

<Embodiment 2>

Now, the second embodiment of the present invention will be described.

Figure 3:
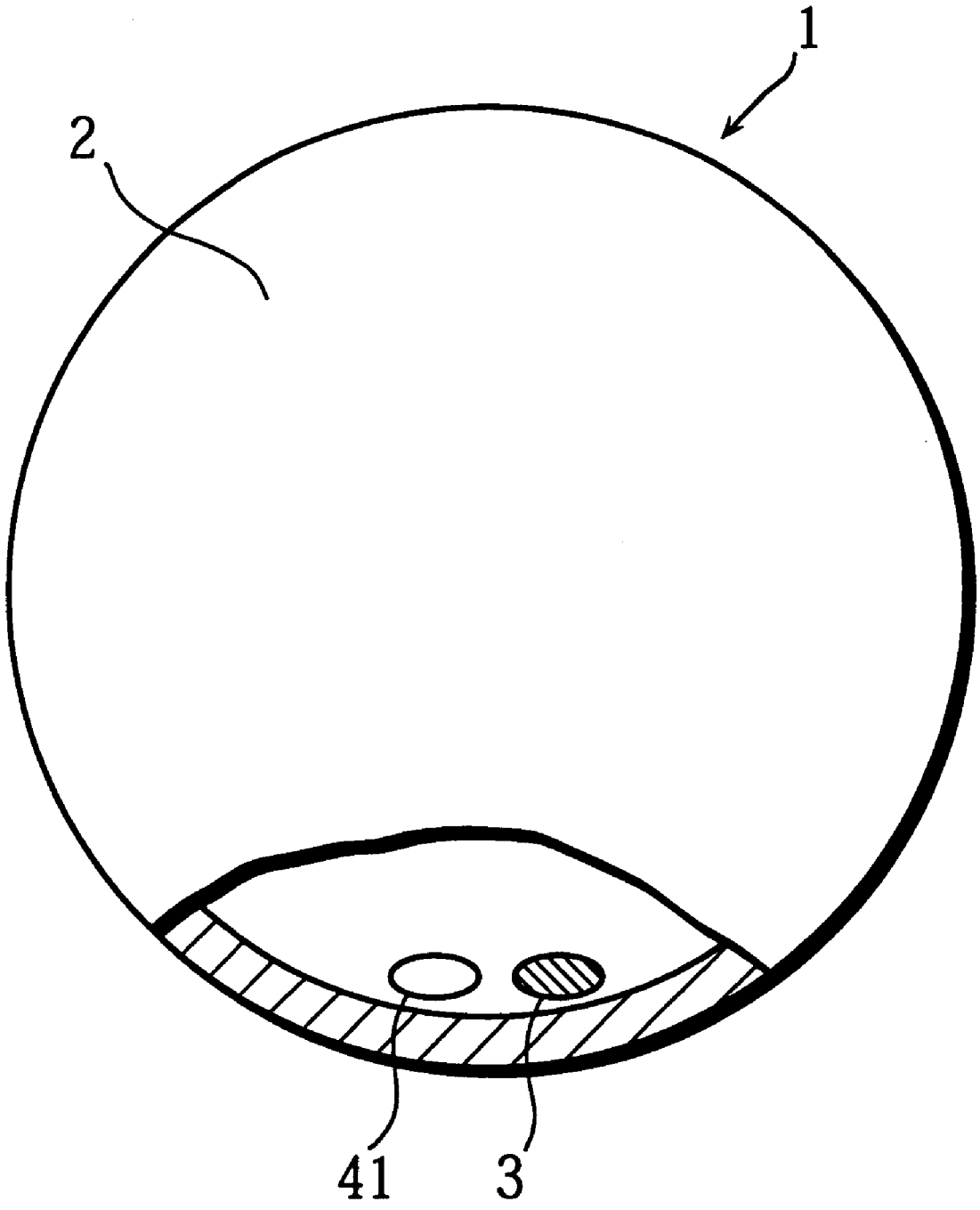
FIG. 3 is a partially exposed front view of the electrodeless discharge lamp of Embodiment 2 of the present invention.

FIG. 3 is a partially exposed front view of the electrodeless discharge lamp of Embodiment 2 of the present invention. As shown in FIG. 3, the construction of the electrodeless discharge lamp of Embodiment 2 is the same as that of Embodiment 1 except that the arc tube contains indium bromide (InBr) 3 as the luminescent substance and indium (In) 41 as a simple substance.

As described earlier, a cause of the devitrification is precipitation of indium. Therefore, some might think that the addition of indium (In) 41 as a simple substance, which is the case of the present embodiment, would enhance the occurrence of the devitrification. However, the inventors of the present invention confirmed by experiments that the addition of indium (In) 41 as a simple substance restricts the occurrence of the devitrification. It is thought that this is because elements of indium dissociated from indium bromide (hereinafter referred to as dissociated indium) participate in the devitrification in a different manner from elements of indium generated from evaporation of indium as a simple substance (hereinafter referred to as evaporated indium).

Since indium has a low melting point, a high boiling point, and a low vapor pressure, indium as a simple substance, if not added in a large amount, does not evaporate completely while the lamp is lighted. It is thought that the remaining simple-substance indium adjusts the summation of the existing evaporated indium and dissociated indium to be kept almost at a constant amount. More specifically, it is thought that the dissociated indium is absorbed in the remaining simple-substance indium due to the evaporation of the simple-substance indium, where it is thought that the evaporated indium does not directly participate in the devitrification while the dissociated indium does participate. Therefore, it is thought that this results in decrease in the precipitation of the dissociated indium on the wall of the arc tube 2, restricting the occurrence of the devitrification of the quartz glass.

The addition of simple-substance indium neither generates unstable discharge nor affects the lamp characteristics such as luminosity as far as a lot of simple-substance indium is not added with reference to the amount of indium bromide enclosed in the arc tube as the luminescent substance since the simple-substance indium has a low vapor pressure even at the temperature during the lamp lighting. Also, it is easy to control the amount of the simple-substance indium to be enclosed in the arc tube since a trace of variation of the amount of the simple-substance indium, whose elements are the same as the elements which determine the lamp characteristics, does not affect the lamp characteristics.

Now, results of an observation performed on the electrodeless discharge lamp of the present embodiment in terms of its characteristics will be described. One test piece used in this observation is an electrodeless discharge lamp with the construction shown in FIG. 3, where the arc tube 2 made of anhydrous quartz glass with 30 mm of inside diameter (GE214A, less than 1 ppm of water content) is filled with 40 mg of indium bromide (InBr) 3, 1.3 kPa of argon gas (Ar), and 3.8 mg of indium (In) 41 as a simple substance (the lamp is hereinafter referred to as indium-added lamp). Another test piece used in this observation is an electrodeless discharge lamp made for comparison with the indium-added lamp, where the same arc tube 2 as the indium-added lamp is filled with 40 mg of indium bromide 3 and 1.3 kPa of argon-gas (the lamp is hereinafter referred to as no-indium-addition lamp). Both lamps were continuously lighted by the microwaves with 800 W of output power generated by the magnetron 6 to observe the occurrence of the devitrification. The following are the results.

Occurrence of the devitrification to a part of the arc tube 2 made of quartz glass was visually observed in the no-indium-addition lamp before the continuous lighting of the lamp reached 500 hours. On the contrary, in the indium-added lamp, occurrence of the devitrification was not observed even the continuous lighting of the lamp reached 2,000 hours, though precipitation of indium was observed.

It will be possible to obtain an effect of slightly raising the color temperature of the lamp light by controlling the cold spot temperature of the arc tube 2 to increase the evaporated indium in spite of the low vapor pressure, that is, to increase the elements of indium in the arc tube 2 to enhance the luminescence in the blue region, which is unique to the elements of indium.

<Variation>

Up to this point, the present invention has been described using various embodiments. However, it is needless to say that the present invention is not limited to the specific examples shown in the embodiments. The present inventions can be varied as follows, for example.

(1) In the above embodiments, quartz glass is used as the material of the arc tube 2 which is to transmit light. However, translucent ceramics or the like may be used instead of quartz glass.

(2) In the above embodiments, indium bromide being a metal halide is used as the luminescent substance. However, another metal halide such as iodide, chloride, or fluoride may be used instead. Also, another group IIIB element such as gallium (Ga), thallium (Tl), or aluminum (Al) may be used as a metal element instead of indium. In any of these cases, the effect of the present invention of controlling the amounts of a metal and a halogen to be enclosed in the arc tube can be obtained by using, as the luminescent substance, a plurality of metal halides which have the same elements but have different compositions, as described in Embodiment 1. Also, the devitrification can be restricted without changing the lamp characteristics by adding, as a simple substance, the metal constituting the metal halide, as described in Embodiment 2.

Meanwhile, an essential method of the present invention is to add a material which restricts the occurrence of the devitrification, where the devitrification is caused by metals precipitated on the wall of the arc tube that melt the material of the arc tube. This method of the present invention is not limited to the addition of a material which constitutes the luminescent substance. That is, the luminescent substance and the material to be added may have different elements. Various combinations of materials, such as indium iodide (InI) and indium tribromide, thallium bromide and indium tribromide, indium iodide and thallium triiodide, and thallium iodide and indium tribromide, may be used to extend the life of electrodeless discharge lamps. To restrict the occurrence of the devitrification, halogen may be added. More specifically, iodine as a simple substance may be added when indium iodide is used as the luminescent substance. The amount of iodine can easily be controlled compared to bromine, chlorine or the like since iodine exists as a solid at ordinary temperature.

(3) In the above embodiments, argon (Ar) is used as the gas for starting-up. However, various rare gases such as helium (He), neon (Ne), krypton (Kr), and xenon (Xe) may be used as gases for starting-up. Especially, use of a rare gas, such as krypton or xenon, having a larger molecular weight than argon interrupts liberated atoms of a metal in reaching the wall of the arc tube, providing the effect of expediting the halogen cycle and enhancing the effect of restricting the devitrification.

(4) In the above embodiments, the cylinder-shaped microwave hollow 10 and the rectangular waveguide 8 are used. However, the shapes and connections of these units are not limited to those described in the embodiments. For example, the microwave hollow 10 may include: a light reflector which is made of a conductive material formed in the shape of a rotation radiation surface; and a conductive mesh disposed so that it closes an opening in the direction of the irradiation of the light reflector. With such a construction, the container with a hollow inside can also be used to effectively irradiate light.

(5) In the above embodiments, the container 7 containing the microwave hollow is made by welding an etched metal mesh plate. However, the container 7 may be formed as follows to further ensure the intensity and light transmittance. For example, a heatproof glass or translucent ceramics may be used as the base material; and a conductive material with a small line width may be pasted on the outer surface of the base material, or the outer surface of the base material may be coated with a mesh-like thin layer of a conductive material, so that the container 7 can interrupt the microwaves in passing through itself.

(6) In the above embodiments, means for supplying energy to light the electrodeless discharge lamp 1 uses microwaves of 2.45 GHz as the energy, the magnetron 6 as a device for generating the microwaves, and the rectangular waveguide 8 as a microwave transmission means. However, the means for supplying energy is not limited to such a construction. For example, the magnetron 6 may be replaced with a solid high-frequency oscillator device, or a waveguide such as a coaxial line may be used as the transmission means. Also, the microwaves of 2.45 GHz may not be used. Instead, a conductive-coupling type electrodeless discharge method may be used in which a high frequency of, for example, 13.56 MHz is applied to a coil disposed at inside or outside the electrodeless discharge lamp 1 to generate a high-frequency field, so that the generated high-frequency field induces electric current into the lamp to establish a discharge.

The present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An electrodeless discharge lamp comprising:

an arc tube in which a luminescent substance and an additive substance are enclosed, wherein the luminescent substance is a metal halide, and the additive substance includes metal in the luminescent substance, and the halogen within the luminescent substance; and composition of the additive substance is different from composition of the luminescent substance.

2. The electrodeless discharge lamp of claim 1, wherein the arc tube is made of a quartz glass, and the luminescent substance is a metal halide including a metal which, as a simple substance, has a boiling point higher than a softening point of the quartz glass.

3. The electrodeless discharge lamp of claim 1, wherein the additive substance is a metal halide, and a ratio of: a summation of the number of moles in a halogen included in the additive substance and the number of moles in a halogen included in the luminescent substance; to a summation of the number of moles in a metal included in the additive substance and the number of moles in the metal included in the luminescent substance is in a range of more than 1.02 and less than 1.07.

4. The electrodeless discharge lamp of claim 1, wherein the metals included in the luminescent substance and the additive substance are elements which belong to the Periodic Table group IIIB.

5. The electrodeless discharge lamp of claim 4, wherein the luminescent substance is a univalent metal halide, and the additive substance is a trivalent metal halide.

6. The electrodeless discharge lamp of claim 1, wherein the luminescent substance is indium bromide, and the additive substance is indium tribromide.

7. An electrodeless discharge lamp comprising:

an arc tube in which a luminescent substance and an additive substance are enclosed, wherein the luminescent substance is a metal halide including a halogen and a metal which is an element belonging to the Periodic Table group IIIB, and the additive substance is a simple substance of the metal included in the luminescent substance.

8. The electrodeless discharge lamp of claim 7, wherein the luminescent substance is indium bromide, and the additive substance is a simple substance of indium.

9. The electrodeless discharge lamp of claim 1, wherein a gas containing a rare gas which has a larger molecular weight than argon is enclosed in the arc tube as a gas for starting-up.

10. An electrodeless discharge lamp comprising:

an arc tube in which a first metal halide and a second metal halide are enclosed, the arc tube being made of a quartz glass, wherein the first metal halide includes a first halogen and a first metal which is an element belonging to the group IIIB, the first metal having a melting point higher than a softening point of the quartz glass, and the second metal halide includes a second halogen and a second metal which is an element belonging to the group IIIB, wherein composition of the second metal is different from composition of the first metal, the second halogen may be the same or different from the first halogen, and the second metal may be the same or different from the first metal, wherein an amount of the first metal halide and the second metal halide enclosed in the arc tube is adjusted so that a ratio of: a summation of the number of moles in the first halogen and the number of moles in the second halogen; to a summation of the number of moles in the first metal and the number of moles in the second metal is in a range of more than 1.02 and less than 1.07.

11. The electrodeless discharge lamp of claim 10, wherein the first metal halide is a univalent metal halide, and the second metal halide is a trivalent metal halide.

12. The electrodeless discharge lamp of claim 11, wherein the first metal and the second metal are the same, and the first halogen and the second halogen are the same.

13. The electrodeless discharge lamp of claim 12, wherein the first metal halide is indium bromide, and the second metal halide is indium tribromide.

14. An electrodeless discharge lamp comprising:

an arc tube in which a simple substance of a first metal and a metal halide as a luminescent substance are enclosed, the arc tube being made of a quartz glass, wherein the metal halide includes a halogen and a second metal which is an element belonging to the group IIIB, the second metal having a melting point higher than a softening point of the quartz glass, and the first metal is equivalent to the second metal.

15. The electrodeless discharge lamp of claim 14, wherein the metal halide is indium bromide, and simple substance of the first metal is indium.

16. An electrodeless discharge lamp apparatus comprising:

an electrodeless discharge lamp including an arc tube in which a luminescent substance and an additive substance are enclosed, wherein the luminescent substance is a univalent metal halide which includes a halogen and a metal being an element belonging to the Periodic Table group IIIB, and the additive substance is a simple substance of the metal included in the luminescent substance; and an excitation energy supplying means for supplying to the electrodeless discharge lamp an energy for exciting the luminescent substance to emit light.

17. The electrodeless discharge lamp apparatus of claim 16, wherein the excitation energy supplying means is a microwave generating means for radiating a microwave onto the electrodeless discharge lamp.

18. The electrodeless discharge lamp apparatus of claim 16, wherein the luminescent substance is indium bromide, and the additive substance is indium as a simple substance.

19. An electrodeless discharge lamp apparatus comprising:

an electrodeless discharge lamp including an arc tube in which a first metal halide and a second metal halide are enclosed, the arc tube being made of a quartz glass, wherein the first metal halide includes a first halogen and a first metal, and the second metal halide includes a second halogen and a second metal, and an amount of the first metal halide and the second metal halide enclosed in the arc tube is adjusted so that a ratio of: a summation of the number of moles in the first halogen and the number of moles in the second halogen; to a summation of the number of moles in the first metal and the number of moles in the second metal is in a range of more than 1.02 and less than 1.07; and an excitation energy supplying means for supplying to the electrodeless discharge lamp an energy for exciting the luminescent substance to emit light.

20. The electrodeless discharge lamp apparatus of claim 19, wherein the excitation energy supplying means is a microwave generating means for radiating a microwave onto the electrodeless discharge lamp.

21. The electrodeless discharge lamp of claim 19, wherein the first metal halide is indium bromide, and the second metal halide is indium tribromide.

* * * * *